US005107087A

United States Patent [19]

Yamada et al.

[11] Patent Number: 5,107,087

[45] Date of Patent: Apr. 21, 1992

[54] COOKING INSTRUMENT USING A MICROWAVE OVEN FOR HEATING A PRIMARY COOKING SURFACE

[75] Inventors: Katsuya Yamada; Shosuke Yamanouchi; Shinichi Toyooka, all of Osaka, Japan

[73] Assignee: Sumitomo Electric Industries, Ltd., Osaka, Japan

[21] Appl. No.: 613,750

[22] PCT Filed: Mar. 27, 1990

[86] PCT No.: PCT/JP90/00410

§ 371 Date: Nov. 26, 1990

§ 102(e) Date: Nov. 26, 1990

[87] PCT Pub. No.: WO90/12256

PCT Pub. Date: Oct. 18, 1990

[30] Foreign Application Priority Data

| | | | |
|---|---|---|---|
| Mar. 31, 1989 | [JP] | Japan | 1-83829 |
| May 23, 1989 | [JP] | Japan | 1-129233 |
| Jun. 10, 1989 | [JP] | Japan | 1-147112 |
| Jul. 18, 1989 | [JP] | Japan | 1-84630 |

[51] Int. Cl.[5] ..... H05B 6/80

[52] U.S. Cl. ..... 219/10.55 E; 219/10.55 F; 99/DIG. 14

[58] Field of Search ..... 219/10.55 E, 10.55 F, 219/451, DIG. 14; 126/390; 426/241, 243, 107

[56] References Cited

U.S. PATENT DOCUMENTS

| | | | |
|---|---|---|---|
| 4,413,167 | 11/1983 | Martel et al. | 219/10.55 E |
| 4,450,334 | 5/1984 | Bowen et al. | 219/10.55 E |
| 4,454,403 | 6/1984 | Teich et al. | 219/10.55 E |
| 4,542,271 | 9/1985 | Tanonis et al. | 219/10.55 E |
| 4,558,198 | 12/1985 | Levendusky et al. | 219/10.55 F |
| 4,701,585 | 10/1987 | Stewart | 219/10.55 E |

FOREIGN PATENT DOCUMENTS

| | | |
|---|---|---|
| 50-152238 | 12/1975 | Japan . |
| 55-36726 | 8/1980 | Japan . |
| 60-223919 | 11/1985 | Japan . |

*Primary Examiner*—Philip H. Leung

*Attorney, Agent, or Firm*—Armstrong, Nikaido, Marmelstein, Kubovcik & Murray

[57] ABSTRACT

The present invention is directed to a cooking container for use in heating food in a microwave oven. Specifically, the present invention concerns a cooking utensil capable of heating itself up by microwaves to heat food to such an extent as to be browned but not to be scorched and be stuck to the cooking surface. A fluororesin layer 1 is formed on the top surface of a metal plate 2, and a heat buildup layer 3 adapted to be dielectrically heated by microwaves is formed on the bottom thereof. A covering 4 permeable to microwaves is provided on the outside of the heat buildup layer. The covering is partially formed into legs to support the bottom surface of the plate. A lid capable of reflecting microwaves may be put on the metal plate to shield the food to be cooked against microwaves.

5 Claims, 4 Drawing Sheets

FIG.1A
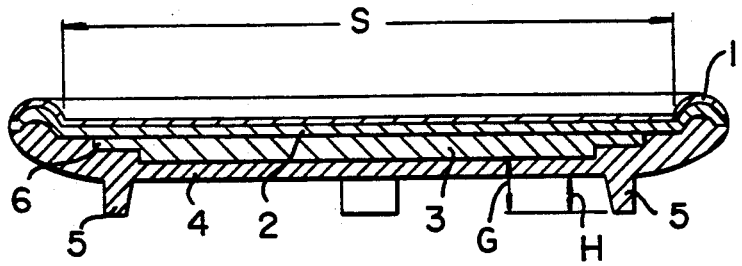
FIG.1B
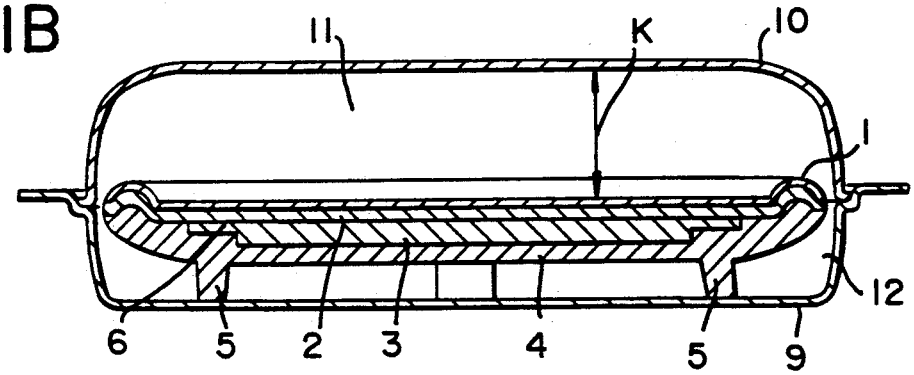
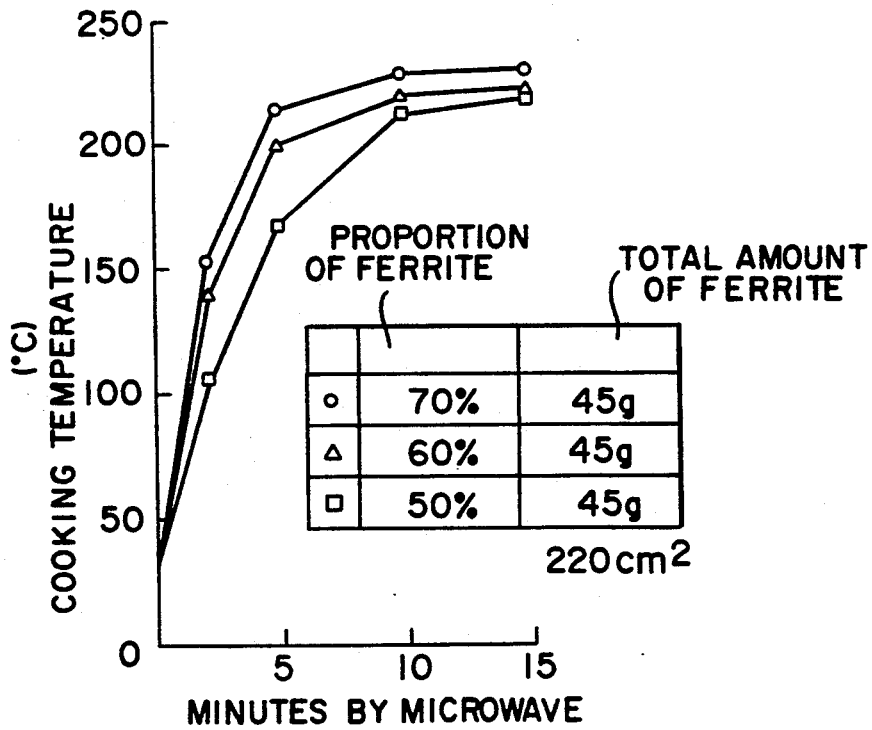
FIG.2

FIG.6A
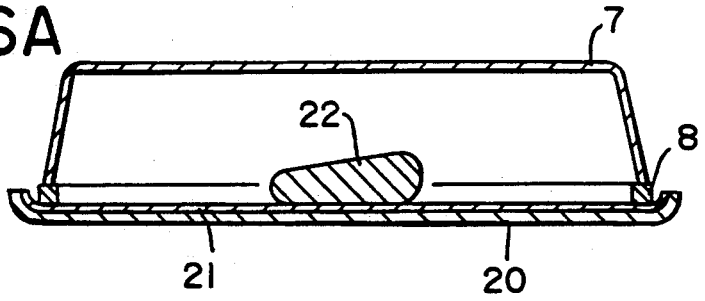
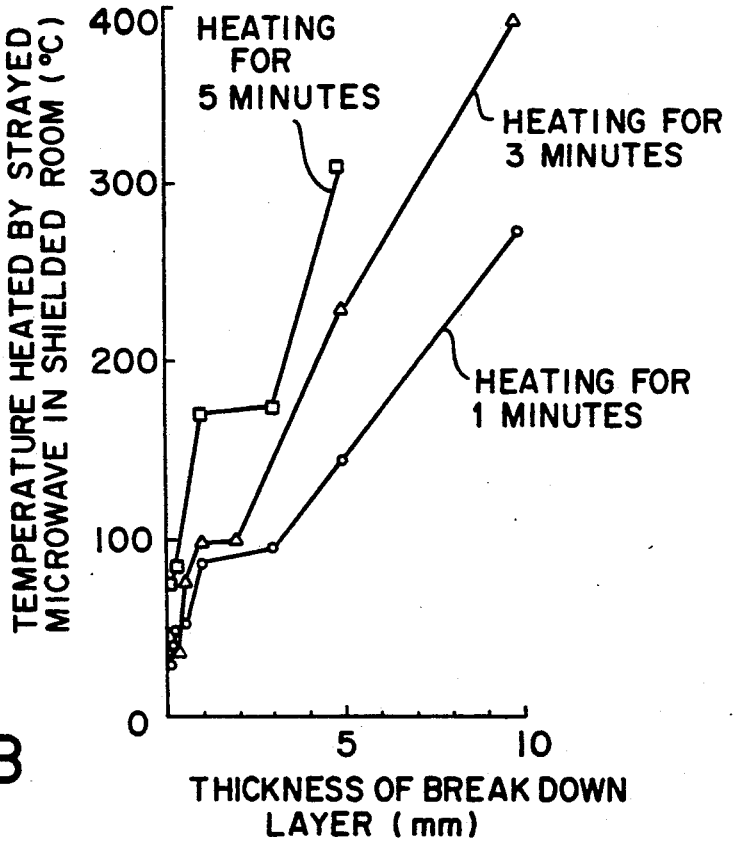
FIG.6B
FIG.7
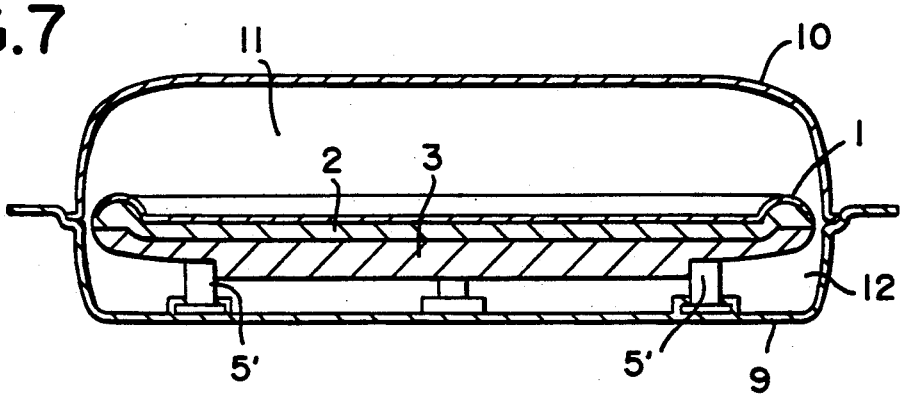

COOKING INSTRUMENT USING A MICROWAVE OVEN FOR HEATING A PRIMARY COOKING SURFACE

TECHNICAL FIELD

The present invention relates to a cooking instrument (cooking container) for use in a microwave oven and more particularly tq a cooking instrument for a microwave oven which has a legs sticky cooking surface and which can easily and safely brown foodstuffs by heating itself up while preventing the from scorching and sticking.

BACKGROUND ART

The instruments used in cooking foods in a microwave oven are roughly classified into two groups.

Those in one group are free of the influence of microwaves and thus do not heat up themselves. Such cooking instruments include heat-resistant glass containers and containers made of plastic such as polypropylene and polycarbonate. These containers have only the function as vessels or containers.

Those in one other group contain ferroelectric substances such as ferrite ($Fe_3O_4$). When the ferroelectric substances are dielectrically heated by microwaves, the foods in the oven are heated by the heat thus produced. Examples of this type are disclosed in Japanese Unexamined Patent Publications 60-223919 and 61-138028.

Of these prior art cooking containers, the latter has a plate in the form of a metal sheet providing a cooking surface and having a ferroelectric material bonded to its back. The dish has its sides bonded to a vessel made of plastic or the like. Thus it was difficult to keep the balance between heat buildup and heat dissipation with such a container.

For the above-described reasons, the prior art cooking containers had the following problems:

I) It is rather difficult to brown the food.

II) If food which is liquid before cooking and solid after cooking and which has a high microwave absorption capacity (e.g. an egg sunny-side up) is cooked in a microwave oven, it might potentially blow up and scatter.

III) If the heat is increased to solve the above problems I and II, the container itself might get broken due to heat storage.

It is an object of the present invention to solve such problems.

DISCLOSURE OF THE INVENTION

The present invention consists of a cooking instrument for use in a microwave oven having a metal plate, a fluororesin layer provided on top of the metal plate, a heat buildup layer provided on the bottom of the metal plate and adapted to be dielectrically heated by microwaves, and a covering permeable to microwaves and provided on the outside of the heat buildup layer, part of the covering being partially formed into legs.

BRIEF DESCRIPTION OF THE DRAWING

FIGS. 1A and 1B are sectional views of the embodiment of the cooking instrument for a microwave oven according to the present invention.

FIG. 2 is a graph showing the relationship between the ferrite in the heat buildup layer and the heat buildup characteristics when heated in a microwave oven.

FIGS. 6A and 6B show the results of experiments conducted to determine the upper limit of the thickness of the dielectric breakdown protective layer. FIG. 6A illustrates how the experiment was done and FIG. 6B is a graph showing the results of experiment.

FIG. 7 is a sectional view of still another embodiment according to the present invention.

BEST MODE FOR EMBODYING THE INVENTION

Figure 3A:
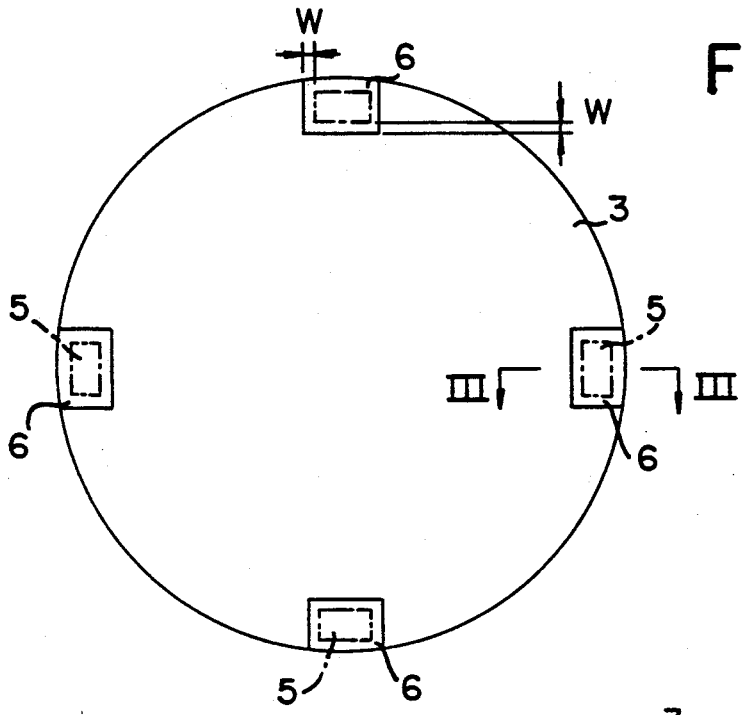
FIG. 3A is a bottom plan view of the embodiment in which the heat buildup layer is thinner at portions where heat dissipation is low than at the remaining portion and FIG. 3B is a sectional view taken along line III—III of FIG. 3A. Broken lines indicate the positions of the legs after the covering has been formed. Slanting lines indicate the portion where the thickness is lower than the other portion.

In order to describe the present invention in more detail, it will be described with reference to the accompanying drawings.

FIG. 1A is a sectional view showing one embodiment of the present invention. A fluororesin layer 1 is provided on a metal plate 2 to prevent scorching and sticking of foods while cooking.

A heat buildup layer 3 is provided on the bottom of the metal plate 2 in an appropriate amount, composition and structure. When the layer 3 is dielectrically heated by microwaves, the heat propagates to the plate 2, heating the food on the film 1.

Outside of the layer 3, there is provided a covering 4 for heat insulation and dissipation. Its thickness determines the balance between heat insulation and dissipation. Part of the covering is formed into legs 5 supporting the bottom of the cooking container. Heat dissipation is low at these portions. Therefore if the heat buildup layer has the same thickness at these portions as the remaining part, temperature tends to rise more sharply at these portions. This may cause breakage. Thus the heat buildup layer is thin at these portions as shown at 6.

The legs 5 have a suitable height H. If they are too high, the irradiation of microwaves will be too much, causing overheating. If too low, heat buildup will be insufficient. G indicates the height of the bottom surface of the heat buildup layer and S the cooking surface.

FIG. 1B shows another embodiment. A pan 9 and a lid 10 are provided to prevent foods from drying and liquid substances such as oil from scattering. Both are in contact with the body of the cooking container only at 5 in order to prevent breakage by heat, to facilitate adjustment of the balance of heat dissipation from the body of the cooking container, and to keep their temperature low enough to be handled with bare hands.

The cooking container for a microwave oven according to this invention is intended for use in a home-use microwave oven having an output of about 500 watts. Therefore, any considerable changes in the output of the microwave oven used or the mechanism for generating microwaves may make it necessary to change the design-related numerical values that appear in the specification including the embodiments of the present invention. But it would not be difficult to design a cooking container based on the concept and the process of the present invention.

The microwave oven referred to in the specification of the present invention is a Hi-Cooker RE-122, 500 Watts in output, made by Sharp Corporation.

As a main material of the fluororesin layer provided on top of the metal plate, PTFE (tetrafluoroethylene resin), PFA (tetrafluoroethylene-perfluorovinylether copolymer), FEP (tetrafluoroethylene-hexafluoropropylene copolymer), ETFE (tetrafluoroethylene-ethylene copolymer), CTFE (trifluorochloroethylene resin) or a combination thereof may be used. It is preferable to use tetrafluoro ethylene resin as a main ingredient because it has the highest heat resistance.

As methods for providing a fluororesin layer, a method of roughening the metal surface, applying a fluororesin dispersion on the metal surface and baking the dispersion thereto, a method of applying an adhesive and then a fluororesin dispersion on the metal surface and baking the dispersion thereto, and a method of laminating a fluororesin layer are known. Any of the above methods may be employed.

Such a fluororesin layer may be provided before or after forming the metallic sheet into a plate. Further, it may be provided even after the plate has been laminated to another member.

The fluororesin layer should be 15–50 microns thick, preferably 20–40 microns. These values represent ranges within which the film shows an optimum film formability and durability.

The heat buildup layer provided on the bottom surface of the metal plate should be made of a material which can be dielectrically heated by microwaves, i.e. a ferroelectric material or a material containing a ferroelectric substance. From the viewpoint of food sanitation and from an economic viewpoint, it should be made of a silicone rubber having ferrite particles ($Fe_3O_4$) dispersed therein.

The particle diameter of the ferrite particles is not limited but for good dispersability in the silicone rubber and workability, it should be 200 microns or less, preferably 100 microns or less.

Their purity will not pose any specific problems. Commercially available ones having a purity of 95 percent would be sufficient. But it is important that they do not contain any metallic impurities which are not desirable from the viewpoint of food sanitation or substances which may hamper vulcanization of silicone rubber.

As a silicone rubber, polydimethyl siloxane, polydimethyl siloxane containing vinyl groups, polydimethyl siloxane containing phenyl groups, or a fluorine silicone rubber may be used. For better heat resistance, polydimethyl siloxane containing phenyl groups is preferable.

Because the heat value is determined by the absolute amount of the ferrite particles, even if the content of the ferrite particles is low, the heat value will remain the same as far as the total amount is unchanged. But, what matters in practical use is the temperature at the cooking surface. Namely, it is important that the cooking surface can be heated to a necessary temperature in a short period of time and not be heated excessively.

FIG. 2 shows what influences the content of the ferrite particles has on the rising speed of temperature at the cooking surface. After measuring the temperature at each predetermined time, the container was heated continuously in a microwave oven. The microwave oven used was a Hi-Cooker RE-122, 500 W in output, made by Sharp Corporation. The temperature was measured directly by use of a surface thermometer.

The higher the content of the ferrite particles, the higher the rising speed of temperature. The content should preferably be 60 per cent or more. But it should not exceed 80 per cent. Within this range, the silicone rubber can function as a binding agent and the workability during manufacturing is good.

Next, we shall discuss the thickness of the heat buildup layer. If the content of the ferrite particles is restricted within the range of 60 to 80 per cent by weight as described above, the heat value is determined solely by the thickness of the heat buildup layer.

Cooking containers having heat buildup layers containing 70 per cent by weight of ferrite particles and having different average thicknesses and thus having different heat buildup properties were prepared. They were tested for the heat value (in terms of period of time taken to heat the cooking surface to 200° C., a temperature necessary for cooking), the cooking time, the cookability (in terms of easiness of browning of food), the durability when heated for a long time in the same manner as in the preheating before cooking (i.e., heated in an empty state without putting on the lid), and the durability when heated under the harshest misuse condition, i.e. heated in an empty state with the lid on). The results are shown in Table 1.

The heat value has to be large enough to give the food a browning, which is an object of the present invention. Thus the heat buildup layer has to be 1.2 mm or more in thickness, provided the content of the ferrite particles is 70 per cent by weight.

On the other hand, the upper limit of the heat value has to be within such a range that the temperature will not rise so much that the product according to the present invention gets broken, safety can be assured).

An ordinary way of use of the cooking instrument according to the present invention is to preheat it in a microwave oven with its body placed in the pan (in an empty state without putting on the lid) until the cooking surface is heated to 200° C., place food in it, put on a lid, and further heat in the oven.

In actual cooking, the temperature of the instrument tends to be the highest immediately after preheating. When food is placed on the instrument, the food serves to deprive the instrument of heat, thus lowering the latter's temperature. As it is heated further, the temperature will rise again. However, because the food absorbs both microwaves and heat transferred from the heat buildup layer, the temperature of the instrument will not rise too much within an ordinary cooking time.

Thus, it is considered reasonable to make judgement on safety by comparing the time required for preheating with the time during which the instrument can withstand heating in an empty and lid-less state. The strictest standard of judgement on safety would be to compare the total time required for cooking with the time during which the instrument can withstand heating under the harshest misuse condition. Namely, it is considered to be the lowest safety level that the instrument would not break even if it is misused for a time equal to an ordinary cooking time. In this respect, the heat buildup layer has to be 2.0 mm thick or less, provided the content is 70 percent by weight.

From these results, it is judged that the heat buildup layer should have an average thickness of between 1.2 mm and 2.0 mm, provided the content of the ferrite particles is 70 per cent by weight.

Calculating and estimating from the absolute amount of the ferrite particles, the preferable thickness within the content range from 60 to 80 percent by weight should be from 1.4 mm to 2.33 mm for 60 per cent by weight and from 1.05 mm to 1.75 mm for 80 per cent by weight.

Figure 4:
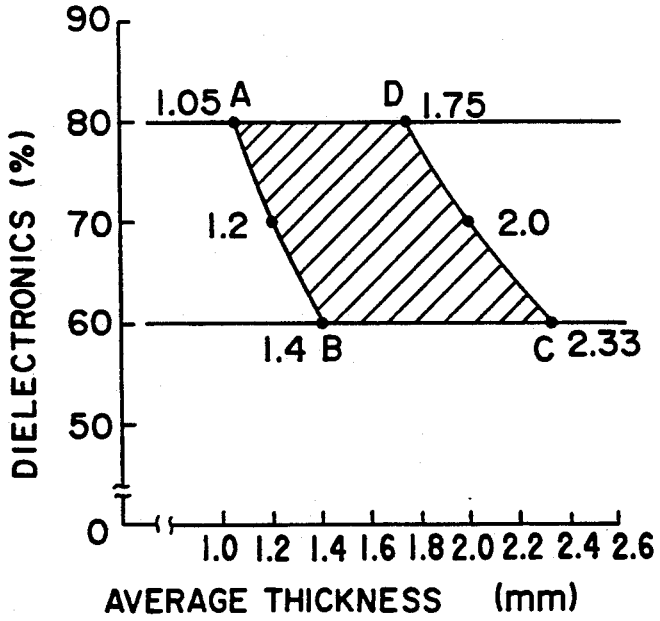
FIG. 4 shows the optimum ranges of the composition of the ferroelectric substances contained in the heat buildup layer and the average thickness of the heat buildup layer.

This range is shown in FIG. 4 by a shadowed area surrounded by four points A–D.

Next, description will be made on the leg portions and the height of the plate.

Because heating by a microwave oven is dielectric heating by microwaves, how the microwaves hit the heat buildup layer greatly affects the heat value. Particularly with the cooking instrument according to the present invention, because the heat buildup layer is formed on the bottom of the metal plate adapted to reflect microwaves, the heat value tends to fluctuate greatly depending upon the height of the plate and particularly the height of the heat buildup layer. That is, the higher the plate, the more it is irradiated with microwaves and thus the higher the heat value.

In order to attain a heat value within a desired range with the above-described cooking container according to the present invention, it is necessary that the bottom of the heat buildup layer be from 13 cm to 23 cm above floor. The height of the leg is dependent partly on the thickness of the covering.

The thickness of the covering should be within such a range that the heat buildup layer can function both as a heat insulating material and a heat dissipating material in a balanced manner and that the heat capacity of the entire cooking container would not be so large as to slow down the rising speed of the temperature at the cooking surface. Generally, it should be from 0.5 mm to 3 mm.

The height of the legs, the value given by subtracting the thickness of the covering from the height of the bottom of the heat buildup layer, should be from 10 mm to 22.5 mm.

Basically, it is preferable that the heat buildup layer has a uniform thickness. But in practice a slight adjustment may be necessary depending on the shape of the plate and the thickness of the covering. Namely, the temperature inside the heat buildup layer tends to be locally higher at portions where heat dissipates less due to a thicker covering or a particular shape of the plate or at portions where the heat buildup layer is locally thick due to uneven forming. Such portions are more likely to be broken by heat. Thus, in order to make uniform the internal temperature at every part of the heat buildup layer, it is necessary to form the heat buildup layer thinner at such portions than at the remaining portion. Heat dissipation from the heat buildup layer is especially low at the root of the legs and temperature tends to rise at these portions. Thus the heat buildup layer has to be thin at these portions. Preferably, these portions are portions just over the legs including portions 1 cm apart from the legs.

For similar reasons as with the heat buildup layer, the covering should be made of a silicone rubber, especially polydimethyl siloxane containing phenyl groups.

The silicone rubber used for the heat buildup layer and the covering may contain a coloring agent, if necessary. They should preferably be press-molded by use of a metal mold. They are subjected to vulcanization and secondary vulcanization at known temperatures for known periods of time. Any vulcanizing agent used for vulcanizing a silicone rubber can be used. It is necessary to use a silicone primer as an adhesive at the interface with the metal plate.

The pan should be made of a material capable of transmitting microwaves, (i.e., a material having a low dielectric loss factor). Most typically glass, porcelain, pottery, rubber and engineering plastic may be used. It is especially desirable to use polyethylene, polypropylene or poly-4-methylpentene-1 as a hydrocarbonplastic, PTFE, PFA, FEP or ETFE as a fluororesin, and polycarbonate, polysulfone or polyetherimide as other engineering plastics.

The lid 10 is made of a material selected from a group of materials similar to those for the pin 9.

By the provision of the pan and the lid, the container can be handled with bare hands. The food in the container is prevented from drying due to evaporation of its water content, and its liquid substances are prevented from scattering.

The pan should be in contact with the body of the container only by the legs so that the former will not be melted and broken by the heat transferred from the heat buildup layer.

Figure 5A:
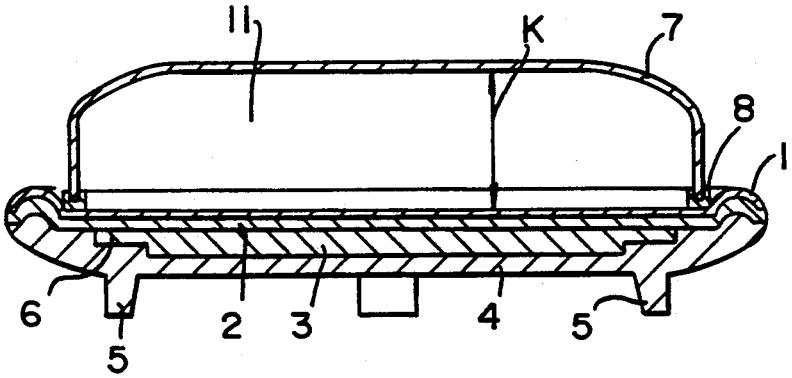
FIG. 5A is a sectional view of another embodiment according to the present invention.
Figure 5B:
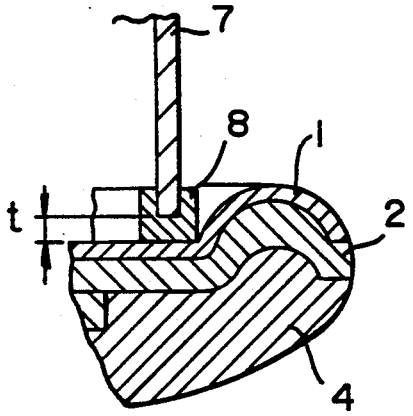
FIG. 5B is an enlarged view of the layer for preventing dielectric breakdown.

FIGS. 5A and 5B show another embodiment of the present invention.

A heat buildup layer 3 is subjected to dielectric heating by microwaves. The heat thus produced is transmitted to a metal plate 2, heating a food placed on fluororesin covering 1. A lid 7 as a shield against microwaves serves to keep almost perfectly the microwaves out of the cooking space. Because the fluororesin covering (i.e., an insulating material) is disposed between the lid 7 and the metal plate 2, dielectric breakdown may occur therebetween. In order to prevent this, a layer 8 for preventing dielectric breakdown is provided.

In FIG. 5B, t indicates the thickness of the layer for preventing dielectric breakdown.

Figure 5C:
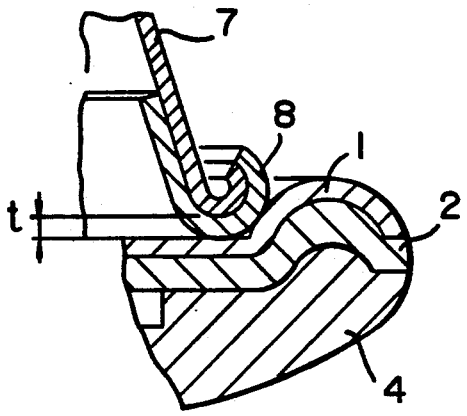
FIG. 5C is an enlarged view of a modified dielectric breakdown protective layer.

The layer may be shaped as shown in FIG. 5C.

The microwave-reflective lid 7 should preferably be made of such a metal as aluminum, an aluminum alloy, iron, stainless steel or copper. However, it may be made of plastic or glass in combination with a metal plate or foil. Since its object is to reflect microwaves, the lid does not necessarily have to be in the form of a flat sheet but may be a meshed or perforated sheet as far as the diameter of the meshes or perforations is small enough to reflect microwaves.

With this arrangement, the microwaves directed toward the food on the cooking surface from the front side of the metal plate will be reflected by the lid, whereas the microwaves which have reached behind the metal plate will be absorbed mainly by an absorbent material provided on the back of the metal plate.

In this state, a metallic portion of the lid and the metal plate are both electrically charged because they are insulated by the fluororesin covering. Thus, if there is a defect in the fluororesin covering, and especially if it has a thin portion, electric discharge may occur.

Even without such a defect, because the fluororesin covering as an insulating layer has a thickness of only 15–40 microns, it can be easily broken, causing discharge (dielectric breakdown).

This phenomenon occurs more often if there are projections or an flaws on the metal surface or air gap at the metal-insulating material-metal interfaces.

Because such states tend to develop during cooking, in order to prevent dielectric breakdown, an insulating layer capable of withstanding dielectric breakdown is provided at the portion where the lid contacts the cooking surface.

It may be made of any desired material as far as it is an insulating material, (e.g., a rubber material such as silicone rubber and fluororubber, a fluororesin such as PTFE and FEP, a polyimide insulating varnish, ceramics, etc.) It is however required that such a selected material be suited for food processing and have a high heat resistance. Also, it should preferably have good moldability as well as high strength and toughness.

As to the structure, if the dielectric breakdown preventive layer is too thick, microwaves may penetrate it, thus lowering the effect of the primary object, (i.e., to guard against microwaves).

FIGS. 6A and 6B show the results of experiments conducted to determine the upper limit of the thickness of the dielectric breakdown preventive layer. As shown in FIG. 6A, a structure having an aluminum plate 20 covered with a fluororesin layer 21 (about 20 microns) but without a heat buildup layer was prepared. A heating element 22 was provided on its cooking surface and the temperature rise of the heating element was measured for different thicknesses of the dielectric breakdown preventive layer. The graph of FIG. 6B show the results. It is considered that the higher the temperature rise, the more the microwaves tend to penetrate the wall.

From these results, it follows that the thickness should be 3 mm or less and preferably 0.5 mm or less. The lower limit of the thickness should be determined individually according to the material selected because it depends on the resistance to dielectric breakdown and the mechanical strength.

By the provision of the lid to guard against microwaves and of the dielectric breakdown preventive layer, the microwaves absorbed directly in the food can be kept to a minimum, if any. This will prevent any sharp rise in the temperature of the food. Microwaves are absorbed in the microwave absorbing material and turn into heat, which heats the metal plate by heat transfer from below. Thus the food on the cooking surface can be cooked in exactly the same manner as it is cooked on a frying pan.

Also the container can be used stably without the fear of dielectric breakdown.

In FIG. 5A, the lid 7 for shielding against microwaves is provided over the container body so as to define a cooking space 11 (which is to be described later). Its volume per unit projected area of the food should be 8.4 $cm^3/cm^2$ or less. The lid should preferably have a sufficient height K so as not to touch foods to be cooked, such as eggs sunny-side up, eggrolls, "gyoza" (dumplings Chinese style) and crepes.

The volume of the abovementioned cooking space is the volume given by subtracting the volume of the food to be cooked from the volume of the space defined by the lid and the cooking surface.

In the embodiment shown in FIG. 1B, if the lid 10 capable of transmitting microwaves is used and if it is made of a polymer such as engineering plastics, it might melt and break if it is brought into direct contact with the cooking surface. Thus a tray 9 should be provided to support the lid 10.

In such a case, the cooking space is composed of not only the upper space 11 but also a lower one 12. Because vapor is less likely to flow into the space 12, the food is prevented from drying even if the sum of the volumes of the spaces 11 and 12 exceeds 8.4 $cm^3/cm^2$ considerably. It is known from experience that only the space 11 can be regarded as the cooking space. In FIG. 1B, K designates the height of the lid.

The microwave-reflective lid 10 is made of a material selected from metals such as aluminum, an aluminum alloy, iron, stainless steel and copper. It may be made of plastics or glass with a metal plate or foil laminated thereto.

The microwave-permeable lid 10 is made of a material selected from glass, ceramics such as porcelain and plastics.

In any case, a heat-resistant lid is placed directly on the cooking surface and a lid having a low heat resistance has to be supported on the tray 9.

Without the above-described cooking space, the food to be cooked tends to be heated not only by heat transfer through the cooking surface but also heated directly by microwaves. This will deprive the food of water content by evaporation and dry it, thus lowering its taste, especially with such foods as eggs sunny-side up, eggrolls or "gyoza"

Even if there is a cooking space, if it is too large, its humidity tends to be so low that the water content in the food will keep evaporating. As a result, the food will be dried to such an extent that its taste worsens noticeably by the time the cooking is complete. On the other hand, by setting the volume of the cooking space per projected area of the food at 8.4 $cm^3/cm^2$ or less, the humidity in the cooking space can be kept high using the water content which evaporated from the food at the beginning of cooking. This high humidity serves to restrain the evaporation of the water content within such a range as not to worsen the taste of the food noticeably.

FIG. 7 shows another embodiment of the present invention. Legs 5', prepared separately from the body, are secured directly to the heat buildup layer 3. If the microwave oven used has such a structure that microwaves cannot readily reach the heat buildup layer or has a low output, the heat value can be increased by replacing the legs with higher ones. The height of the legs are determined depending upon the type of the microwave oven used.

This embodiment is industrially advantageous because it can be used with every type of microwave oven with a simple replacement of legs without the need for changing the way of cooking according to the type of the microwave oven used or the need for preparing different types of containers applicable to different types of microwave ovens.

Since the legs are used to directly support the heat buildup layer, they have to be made of a heat-resistant material having at least a heat resistance of 250° C. or more. For example, they may be made of a silicone rubber, a heat-resistant engineering plastic such as PPS, glass, porcelain or pottery.

EXPERIMENT EXAMPLE 1

One side of an aluminum sheet 200 mm in outer diameter and 0.8 mm thick was subjected to electrochemical etching to form microscopic irregularities thereon. Then a dispersion of tetrafluoroethylene resin was applied to this side and baked for 20 minutes at 380° C. Then the aluminum sheet was press-molded with the tetraethylene resin covering the upside to form an aluminum plate having a diameter of about 170 mm.

After applying and baking a primer to the bottom of the plate, the aluminum plate was further molded, with the heat buildup layer made of a silicone rubber containing 70 percent of ($Fe_3O_4$) (ferrite DDM-31 made by Dowa Teppun Kogyo Co., Ltd., purity: about 95%, particle diameter: 200 microns or less), so that its diameter was 145 mm and its thickness 2.4 mm. Further, a silicone rubber (KE552BU made by Shinetsu Kagakusha Co., Ltd.) 1.1 mm thick was formed as a covering on top and along the edge of the aluminum plate. Parts of the covering were formed into legs 15 mm high. The plate was then vulcanized under pressure by use of a mold. After taking it out of the mold, it was subjected to secondary vulcanization to form a cooking container.

The container thus obtained was heated for three minutes in a microwave oven. The temperature on the cooking surface was increased to 210° C.

After heating for three minutes in an empty state, a commercially available frozen pizza (Pizza-and-Pizza made by Meiji Nyugyo Co., Ltd.) was placed in the container and heated for another three minutes in the microwave oven. The bottom of the pizza dough was browned beautifully and the cheese on top was melted properly.

EXPERIMENT EXAMPLE 2

The same container as used in EXPERIMENT EXAMPLE 1 was placed in a pan made of poly-4-methylpentene-1 and heated for three minutes in a microwave oven. The temperature on the cooking surface was increased to 220° C. After the three-minute empty-state heating, a commercially available frozen pizza was placed in the container and heated for another three minutes in the microwave oven. The pizza was browned beautifully on its bottom and the cheese on top was melted properly. The temperature at the edge of the tray was 37° C. after empty heating and 39° C. even after cooking, which were low enough to be handled with bare hand.

EXPERIMENT EXAMPLE 3

A container which was the same as used in EXPERIMENT EXAMPLE 1 except that the heat buildup layer was 1.6 mm thick and the covering 0.9 mm thick was placed in a pan made of poly-4-methylpentene-1 and heated for four minutes in a microwave oven. The temperature on the cooking surface was increased to 224° C.

After the four-minute empty heating, a lid made of poly 4-methylpentene-1 and adapted to touch only the pan was put on the container with raw hen's eggs placed therein and the container was heated for two minutes in the microwave oven. Eggs sunny-side up were made having a good browning on the bottom. Their top was not dried. In fact, they were just like those cooked on a frying pan. Further, there was no difficulty in removing them from the container because they did not stick to the cooking surface.

After cooling down the container to room temperature, it was used under the harshest misuse condition, that is, heated in an empty state with the pan and the lid set in place. After 10 minutes, the silicone rubber bulged around the legs. Another five minutes' heating developed several bulges 5–30 mm in diameter over the entire covering of silicone rubber.

EXPERIMENT EXAMPLE 4

Figure 3B:
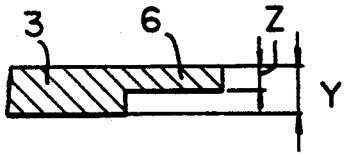

A container used in this example is the same as that used in EXPERIMENT EXAMPLE 1 except that as shown in FIG. 3 the heat buildup layer has a thickness Y of 1.6 mm but with its portions corresponding to the legs and their peripheral portions within the range W of 1 cm from the legs having a thickness z of 0.8 mm and that the covering is 0.9 mm thick. It was placed in a pan made of poly 4-methylpentene-1 and heated for four minutes. After the heating, the temperature at the cooking surface was 218° C.

After the four-minute empty heating, a lid made of poly 4-methylpentene-1 and adapted to touch only the pan was put on the container with raw hen's eggs placed on the cooking surface. The container was then heated about 2.5 minutes in a microwave oven. The eggs sunny-side up thus made had a beautiful browning on their bottom and their top was not dried. They were equivalent in quality to those made on a frying pan. Further, they never stuck to the cooking surface and thus could be removed from the container very easily.

In another experiment, after heating the container for four minutes in an empty state, pizza, "gyoza", crepes, bacon, ham and meat were placed in the container to cook. They were all cooked nicely with a browing on their bottom and never stuck to the cooking surface.

After cooling down the cooking container to room temperature, it was heated under the harshest misuse condition, (i.e., heated in an empty state with the pan and the lid set in place). After 10 minutes, the temperature at the cooking surface reached 292° C. But there was nothing wrong with the container. When heated for another five minutes, bulges 20 mm in diameter developed on the silicone rubber at the root of the legs. Otherwise, there was nothing abnormal.

EXPERIMENT EXAMPLE 5

A cooking container was prepared which was the same as that used in EXPERIMENT EXAMPLE 1 except that the heat buildup layer was 0.5 mm thick and the silicone rubber covering was 1.0 mm thick.

A lid 7, 170 mm in diameter and 35 mm thick was formed from an aluminum sheet 0.7 mm thick. A 0.5 mm thick silicone rubber packing 8 having the shape as shown in FIG. 5C was formed along the edge of the lid.

A lid was put on the cooking container with broken raw eggs placed on the body of the cooking container and the container was heated in a microwave oven (Hi-Cooker RE-130, 500 watts in output made by Sharp Corporation) for four minutes. The eggs sunny-side up thus made had a beautiful browning as made on a frying pan. No dielectric breakdown (sparks) occurred.

EXPERIMENT EXAMPLE 6

The same container and aluminum lid as used in EXPERIMENT EXAMPLE 5 were prepared. An adhesive tape made of PTFE (0.3 mm thick) was stuck on the lid along its edge. Eggs were cooked in a microwave oven. The eggs sunny-side up were browned beautifully. No dielectric breakdown occurred.

EXPERIMENT EXAMPLE 7

A cooking container was prepared which was the same as that used in EXPERIMENT EXAMPLE 5 except that a 2 mm thick packing made of PFA was used. The eggs sunny-side up cooked by use of this cooking container developed a beautiful browning. No dielectric breakdown happened.

EXPERIMENT EXAMPLE 8

An aluminum plate having an internal diameter of about 160 mm was made in the same manner as in EXPERIMENT EXAMPLE 1.

After applying and baking a primer to its bottom, the aluminum plate was molded, with the heat buildup layer made of a silicone rubber (KE552BU made by Dowa Teppun Kogyo Co., Ltd.) containing 70% of $Fe_3O_4$ (ferrite DDM-31 made by Shinetsu Kagakusha Co., Ltd., purity: about 95%, particle diameter: 200 microns or less), so that the diameter was 145 mm and the thickness 0.6 mm. A 0.9 mm thick covering of a silicone rubber (KE552BU) and another 1.5 mm thick covering were put on top and along the edge of aluminum plate, respectively. Parts of the covering were formed into legs 15 mm high. The plate was then vulcanized under pressure by use of a mold. After taking it out of the mold, it was further subjected to the secondary vulcanization to obtain a cooking container.

Aluminum lids having different volumes as shown in Table 2 were put on the body of the cooking container (as shown in FIG. 5A). With one each hen's egg placed on the cooking surface, the container was heated for two minutes in a microwave oven (Hi-Cooker RE-122, 500 watts in output made by Sharp Corporation) to make an egg sunny-side up.

Ten eggs sunny-side up were made under different conditions from one another to check their dryness (taste). This examination was conducted by 10 persons, 8 male adults and 2 female adults. If there were seven or more persons who thought the egg tested was not dried and thus tasty, a good mark (◯) was given whereas if there were three or less, a no-good mark (X) was given.

The average projected area of the eggs sunny-side up was 100 $cm^2$.

TABLE 2-continued

| Volume under lid ($cm^3$) | Height of lid (mm) | Volume of cooking space per unit area projected from food | Number of person who felt tasty and not too dry | Judgement on taste | Contact of food on lid |
|---|---|---|---|---|---|
| | | | | | contact (3/10) |
| 220 | 19 | 2.2 $cm^3/cm^2$ | 8 | ◯ | Contact (8/10) |

What is claimed is:

1. A cooking instrument for use in a microwave oven, comprising:

a metal plate;

a heat buildup layer provided on the bottom of said metal plate and adapted to be dielectrically heated by microwaves; and a covering means permeable to microwaves formed on the outside of said heat buildup layer, part of said covering means being formed into legs, for allowing microwaves to substantially heat said heat buildup layer, wherein said heat buildup layer is substantially made of ferroelectric substances containing $Fe_3O_4$ as a main component and a silicone rubber containing phenyl groups, the average thickness of said heat buildup layer being determined so as to be within the range of 1.4 mm to 2.33 mm for 60 percent by weight and from 1.05 mm to 1.75 mm for 80 percent by weight, respectively, including generally corresponding thicknesses for content percentages therebetween, and the bottom of said heat buildup layer being from 13 mm to 23 mm high and the height of said legs being from 10 mm to 22.5 mm.

2. A cooking instrument for use in a microwave oven as claimed in claim 1, further:

a microwave-reflective lid means adapted to be put on said metal plate to cover the top surface thereof, for shielding food to be cooked against microwaves; and

TABLE 1

| Average thickness of heat buildup layer (mm) | Ease of browning | Heatability (time required to heat to 200°C.) (min) | Cooking Time: Preheat time (min) | Cooking Time: Heating time (min) | Cooking Time: Total (min) | Durability: When heated no food without lid | Durability: When heated no-food with lid | Durability: Safety |
|---|---|---|---|---|---|---|---|---|
| 2.4 | ◯ | 2.7~3.0 | Same as left | 2 | 4.7~5 | 5-10 min | Less than 5 min | Δ |
| 2.0 | ◯ | 2.9~3.1 | Same as left | 2 | 4.9~5.1 | — | 5-10 min | ◯ |
| 1.6 | ◯ | 3.4~3.9 | Same as left | 3 | 6.4~6.9 | 30-60 min | 10-20 min | ◯ |
| 1.2 | ◯~Δ | 4.0~5.0 | Same as left | 4 | 8~9 | — | 15-30 min | ◯ |

a layer for preventing dielectric breakdown having a thickness of 3 mm or less and disposed at a contact interface between said lid and said fluororesin layer provided on the top of said metal plate.

3. A cooking instrument for use in a microwave oven as claimed in claim 1 or 2, wherein said legs are separable from said metal plate.

4. A cooking instrument for use in a microwave oven as claimed in claim 2, wherein the volume of the cooking space defined by the volume of the space defined between said lid and the cooking surface relative to the volume of food to be cooked is 8.4 $cm^3/cm^2$ or less with respect to the projected area of the food.

5. A cooking instrument for use in a microwave oven as claimed in claim 1, wherein said heat buildup layer is thinner at predetermined portions where heat dissipates so that the temperature inside said heat buildup layer will be uniform over an entire area thereof while being heated by microwaves.

* * * * *

TABLE 2

| Volume under lid ($cm^3$) | Height of lid (mm) | Volume of cooking space per unit area projected from food | Number of person who felt tasty and not too dry | Judgement on taste | Contact of food on lid |
|---|---|---|---|---|---|
| 1200 | 70 | 12.0 $cm^3/cm^2$ | 0 | × | No |
| 1060 | 58 | 10.6 $cm^3/cm^2$ | 0 | × | " |
| 920 | 50 | 9.2 $cm^3/cm^2$ | 3 | × | " |
| 840 | 45 | 8.4 $cm^3/cm^2$ | 5 | Δ | " |
| 720 | 40 | 7.2 $cm^3/cm^2$ | 7 | ◯ | " |
| 500 | 30 | 5.0 $cm^3/cm^2$ | 8 | ◯ | " |
| 300 | 22 | 3.0 $cm^3/cm^2$ | 10 | ◯ | Partially |